US011619148B2

(12) United States Patent
Kuylenstierna

(10) Patent No.: US 11,619,148 B2
(45) Date of Patent: Apr. 4, 2023

(54) CYLINDER VALVE ASSEMBLY WITH VALVE SPRING VENTING ARRANGEMENT

(71) Applicant: VOLVO TRUCK CORPORATION, Gothenburg (SE)

(72) Inventor: Claes Kuylenstierna, Mölnlycke (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 17/269,918

(22) PCT Filed: Aug. 23, 2018

(86) PCT No.: PCT/EP2018/072719
§ 371 (c)(1),
(2) Date: Feb. 19, 2021

(87) PCT Pub. No.: WO2020/038574
PCT Pub. Date: Feb. 27, 2020

(65) Prior Publication Data

US 2021/0310383 A1 Oct. 7, 2021

(51) Int. Cl.
*F01L 9/16* (2021.01)

(52) U.S. Cl.
CPC ..... *F01L 9/16* (2021.01)

(58) Field of Classification Search
CPC ..... B60G 2202/152; B60G 17/0155; B60G 2400/51222; B60G 2500/204;
(Continued)

(56) References Cited

U.S. PATENT DOCUMENTS 4,831,973 A * 5/1989 Richeson, Jr. ..... F01L 9/20 123/90.11
5,131,427 A 7/1992 Latza
(Continued)

FOREIGN PATENT DOCUMENTS

CN 101675216 A 3/2010
CN 203979533 U 12/2014
(Continued)

OTHER PUBLICATIONS

International Search Report and Written Opinion dated Apr. 25, 2019 in corresponding International PCT Application No. PCT/EP2018/072719, 11 pages.
(Continued)

*Primary Examiner* — Devon C Kramer
*Assistant Examiner* — Wesley G Harris
(74) *Attorney, Agent, or Firm* — Venable LLP; Jeffri A. Kaminski

(57) ABSTRACT

The invention relates to a cylinder valve assembly (19) comprising a pneumatic valve spring arrangement (25) including a first (29) and a second (31) valve spring member defining a valve spring cavity (33), and a valve spring venting arrangement (27) comprising a first venting cavity portion (37) in fluid flow connection with the valve spring cavity (33); a second venting cavity portion (39); a movable sealing member (41) arranged to allow a pressure difference between the first venting cavity portion (37) and the second venting cavity portion (39); a feedback channel fluid flow connecting the first venting cavity portion (37) and the second venting cavity portion (39); and a venting channel (53). The sealing member (41) is configured to be movable between a first sealing member position where the sealing member (41) prevents fluid flow from the first venting cavity portion (37) through the venting channel (53); and a second
(Continued)

sealing member position where the sealing member (41) allows fluid flow from the first venting cavity portion (37) through the venting channel (53). The valve spring venting arrangement (27) further comprises an elastic member (55) urging the sealing member (41) towards the first sealing member position.

11 Claims, 5 Drawing Sheets

(58) Field of Classification Search
CPC ..... B60G 17/052; Y02T 10/12; F01L 1/465; F01L 9/10; F01L 9/16; F01L 2001/34446; F01L 3/10; F01L 9/20
USPC ..... 123/90.12, 90.14, 90.11; 137/906
See application file for complete search history.

(56) References Cited

U.S. PATENT DOCUMENTS

| | | | | | |
|---|---|---|---|---|---|
| 5,988,124 | A * | 11/1999 | Duesmann | F01L 9/20 | 123/90.11 |
| 6,092,495 | A * | 7/2000 | Hackett | F02D 13/0203 | 123/90.15 |
| 7,249,580 | B2 * | 7/2007 | Martinez | F01L 1/465 | 123/90.12 |
| 2003/0136362 | A1 * | 7/2003 | Asano | F01L 9/20 | 123/90.11 |
| 2005/0217619 | A1 | 10/2005 | Martinez | | |
| 2014/0069529 | A1 | 3/2014 | Matsuo et al. | | |
| 2016/0040564 | A1 * | 2/2016 | Hoglund | F16K 31/122 | 251/28 |
| 2017/0037750 | A1 | 2/2017 | Hoglund et al. | | |

FOREIGN PATENT DOCUMENTS

| | | | | | |
|---|---|---|---|---|---|
| CN | 104948792 | A | 9/2015 | | |
| DE | 4202507 | A1 | 8/1992 | | |
| DE | 19733186 | A1 * | 2/1999 | F01L 9/04 | |
| DE | 10243388 | A1 | 3/2004 | | |
| EP | 0269587 | A1 | 6/1988 | | |
| EP | 1167702 | A1 * | 1/2002 | F01L 9/04 | |
| EP | 1577508 | A1 | 9/2005 | | |
| WO | WO-2016167715 | A1 * | 10/2016 | F01B 21/02 | |

OTHER PUBLICATIONS

Chinese Office Action dated Apr. 6, 2022 in corresponding Chinese Patent Application No. 201880096391.8, 14 pages.

* cited by examiner

CYLINDER VALVE ASSEMBLY WITH VALVE SPRING VENTING ARRANGEMENT

CROSS-REFERENCE TO RELATED APPLICATIONS

This application is a U.S. National Stage application of PCT/EP2018/072719, filed Aug. 23, 2018, and published on Feb. 27, 2020, as WO 2020/038574 A1, all of which is hereby incorporated by reference in its entirety.

TECHNICAL FIELD

The invention relates to a cylinder valve assembly for an internal combustion engine arrangement, and to an internal combustion engine arrangement.

The invention can be applied in combustion engine arrangements for various uses, including, but not limited to, passenger cars or heavy-duty vehicles. Heavy duty vehicles may, for example, include trucks, buses and construction equipment. Although the invention will be described with respect to a truck, the invention is not restricted to this particular vehicle, but may also be used in other vehicles such as a bus, or working machines, such as wheel loaders or excavators etc.

BACKGROUND

An internal combustion engine (ICE) typically has at least one cylinder, and a piston caused to move linearly in the cylinder by combustion events taking place inside the cylinder. To admit air, or fuel-air mixture, into the cylinder, the cylinder is generally provided with at least one inlet, and to allow exhaust gases to exit the cylinder, the cylinder is generally provided with at least one outlet. Further, at least one inlet valve is typically provided to control flow through the inlet(s), and at least one exhaust valve is typically provided to control flow through the outlet(s).

Currently, the inlet valves and exhaust valves of most ICEs are urged towards their closed state by a coil spring, dimensioned to exert a spring force that is sufficient to keep its respective valve closed, when desirable, for all foreseen operating conditions of the ICE. This means that the spring force exerted by the coil spring is considerably higher than is necessary for most operating conditions, which means that more energy is spent on opening valves than would be necessary.

By replacing the above-mentioned strong coil spring with a pneumatic valve spring arrangement, the spring force can be controlled by varying the amount of gas being compressed in the valve spring arrangement. In particular, to allow a reduction in spring force, controlled leakage of gas from the valve spring cavity (in which gas is being compressed during opening of the valve) needs to be provided for.

US 2017/0037750 discloses a combustion engine with a pneumatic valve return spring, in which the valve spring cavity is open during a first part of the valve stroke in the beginning of a valve opening sequence, and closed during a second part of the valve stroke in the end of a valve opening sequence.

Although the arrangement according to US 2017/0037750 appears to allow for controllable changes in the valve spring force, it would be desirable to provide for controllable changes in the valve spring force with less loss of pressurized gas, thus providing for increased energy efficiency.

SUMMARY

An object of the invention is to provide for improved energy efficiency of an internal combustion engine arrangement including at least one pneumatic valve spring arrangement.

According the present invention, this object is achieved by a cylinder valve assembly for an internal combustion engine, comprising: a valve; a valve actuator for moving the valve; and a pneumatic valve spring arrangement including a first valve spring member and a second valve spring member defining a valve spring cavity, the second valve spring member being arranged to move in relation to the first valve spring member to compress gas in the valve spring cavity when the valve actuator moves the valve. The cylinder valve assembly further comprises a valve spring venting arrangement comprising: a first venting cavity portion in fluid flow connection with the valve spring cavity; a second venting cavity portion; a movable sealing member arranged to allow a pressure difference between a first gas pressure in the first venting cavity portion and a second gas pressure in the second venting cavity portion; a feedback channel fluid flow connecting the first venting cavity portion and the second venting cavity portion; and a venting channel for gas exhaust from the valve spring venting arrangement, wherein the sealing member is configured to be movable between: a first sealing member position in which the sealing member is arranged in such a way that the sealing member prevents fluid flow from the first venting cavity portion through the venting channel; and a second sealing member position in which the sealing member is arranged in such a way that the sealing member allows fluid flow from the first venting cavity portion through the venting channel, wherein the valve spring venting arrangement further comprises an elastic member urging the sealing member to move from the second sealing member position towards the first sealing member position.

It should be noted that the sealing member may be arranged and configured to allow fluid flow from the first venting cavity portion to the second venting cavity portion through the feedback channel both in the first sealing member position and the second sealing member position.

The elastic member may advantageously be a coil spring.

The present invention is based on the realization that the valve spring force can be changed with less gas leakage by providing a sealing member that is movable to allow leakage against a spring force which depends on the pressure in the valve spring cavity. In particular, the present inventors have realized that a delay in pressure build-up in the second venting cavity portion, together with the elastic member urging the sealing member to move from the second sealing member position towards the first sealing member position, provide for a leakage event in the beginning of each valve opening operation. This allows leakage of gas through a venting channel that may be dimensioned to also allow reliable passage of lubricant, such as oil, through the venting channel.

The valve spring venting arrangement, in particular at least one of the feedback channel, the venting channel, and the elastic member, may advantageously be configured to allow a desired reduction of the valve spring pressure to occur gradually over a number of valve opening operations, such as over at least ten valve opening operations, or over at least one hundred valve opening operations.

According to embodiments, the sealing member may be configured to receive a first force resulting from the first gas pressure in the first venting cavity portion, and a second force resulting from the second gas pressure in the second venting cavity portion. The first force may be directed to urge the sealing member to move towards the second sealing member position, and the second force may be directed to urge the sealing member to move towards the first sealing member position; and the feedback channel, the sealing member, and the elastic member may be dimensioned in such a way that the sealing member is moved from the first sealing member position to the second sealing member position during a portion of the time when the valve actuator moves the valve.

According to various embodiments, furthermore, the first venting cavity portion may be in fluid flow connection with the valve spring cavity through a flow channel having a first minimum cross-sectional area; and the feedback channel may have a second minimum cross-section area smaller than the first minimum channel cross-section area.

These embodiments provide one advantageous way of achieving a desired delay in pressure build-up in the second venting cavity portion. As will be understood by one of ordinary skill in the art, there are numerous ways of achieving the desired delay in pressure build-up. For instance, the feedback channel may be made relatively long. Many other combinations of cross-sectional areas and channel lengths are feasible.

Advantageously, furthermore, the feedback channel may be inclined upwards at least along a feedback channel segment starting from the first venting cavity portion. It may be advantageous to use gas with oil mist in the cylinder valve assembly for lubrication. When allowing gas to leak through the venting channel, oil should also be allowed to leak. In configurations where gas with oil mist is used, it may also be desirable to prevent oil from entering the second cavity portion. This may be achieved by the above-mentioned upwards inclining feedback channel.

The cylinder valve assembly may advantageously further comprise a gas inlet for providing gas to said pneumatic valve spring arrangement. By providing gas through the gas inlet, the valve spring pressure can be increased. The gas inlet may advantageously be provided with a check valve, to prevent gas from flowing out of the cylinder valve assembly through the gas inlet.

According to embodiments, the cylinder valve assembly may further comprise an inlet channel fluid flow connecting the inlet with the first venting cavity portion of the valve spring venting arrangement.

The cylinder valve assembly may further comprise a counter-pressure channel fluid flow connected to the second venting cavity portion.

The feedback channel may comprise the inlet channel, the counter-pressure channel, and a pressure-levelling channel fluid flow connecting the inlet channel and the counter-pressure channel.

Advantageously, a cross-sectional area of the pressure-levelling channel may be smaller than a cross-sectional area of the inlet channel and a cross-sectional area of the counter-pressure channel.

Moreover, a first end of the pressure levelling channel fluid flow connected to the inlet channel may be at a lower vertical level than a second end of the pressure levelling channel fluid flow connected to the counter-pressure channel.

Furthermore, the cylinder valve assembly according to embodiments of the present invention may advantageously be included in an internal combustion engine arrangement, further comprising a cylinder having at least one inlet and at least one outlet; wherein the cylinder valve assembly is arranged to allow control of fluid flow through at least one inlet and/or outlet of said cylinder.

The ICE arrangement may comprise a plurality of cylinders, such as four, six or eight cylinders. Furthermore, each cylinder may advantageously have at least two inlets and at least two outlets.

In summary, aspects of the present invention thus relate to a cylinder valve assembly comprising a pneumatic valve spring arrangement including a first and a second valve spring member defining a valve spring cavity, and a valve spring venting arrangement comprising a first venting cavity portion in fluid flow connection with the valve spring cavity; a second venting cavity portion; a movable sealing member arranged to allow a pressure difference between the first venting cavity portion and the second venting cavity portion; a feedback channel fluid flow connecting the first venting cavity portion and the second venting cavity portion; and a venting channel. The sealing member is configured to be movable between a first sealing member position where the sealing member prevents fluid flow from the first venting cavity portion through the venting channel; and a second sealing member position where the sealing member allows fluid flow from the first venting cavity portion through the venting channel. The valve spring venting arrangement further comprises an elastic member urging the sealing member towards the first sealing member position.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
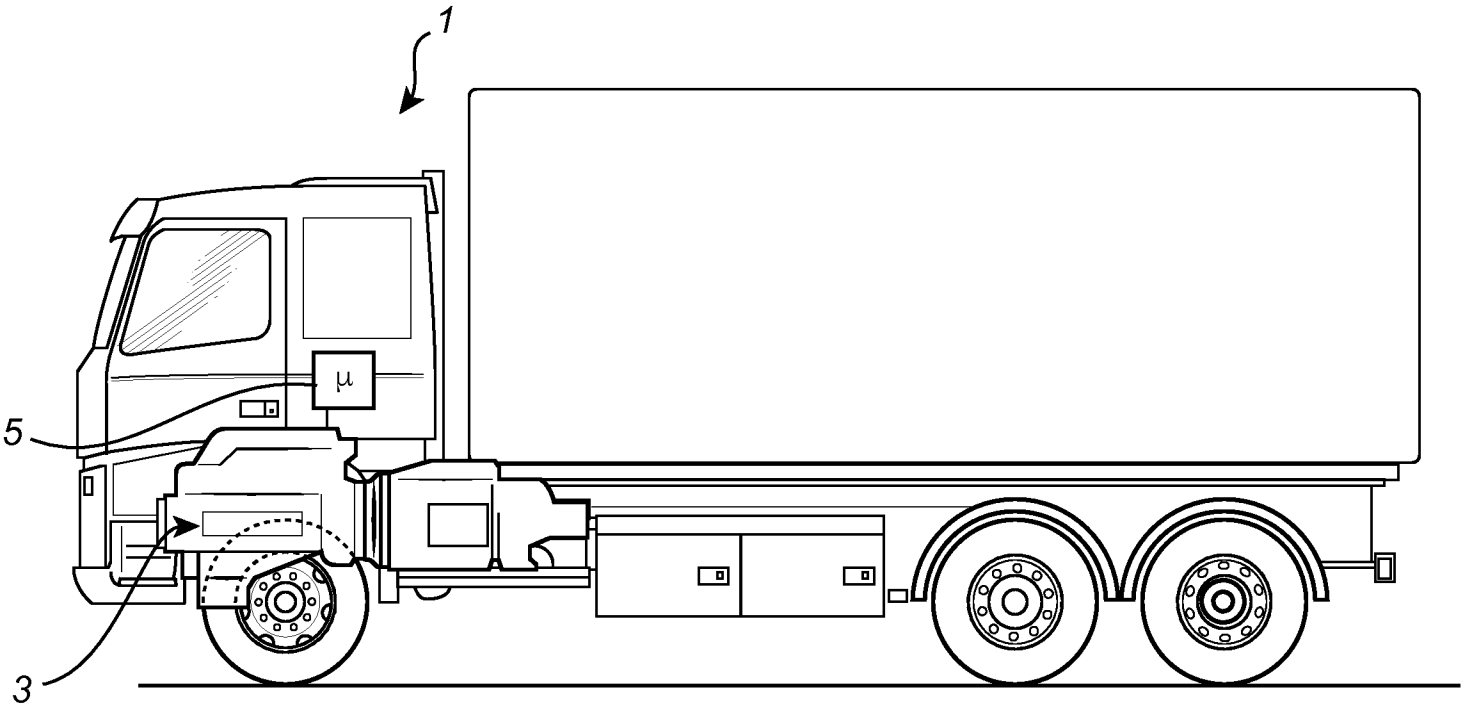
FIG. 1 is a side view of a vehicle according to an example embodiment of the present invention, in the form of a truck.

FIG. 1 schematically shows a vehicle, here in the form of a truck 1, including an ICE arrangement 3 according to an example embodiment of the present invention. The ICE arrangement 3 comprises a control unit 5 for controlling operation of the ICE arrangement 3.

Figure 2:
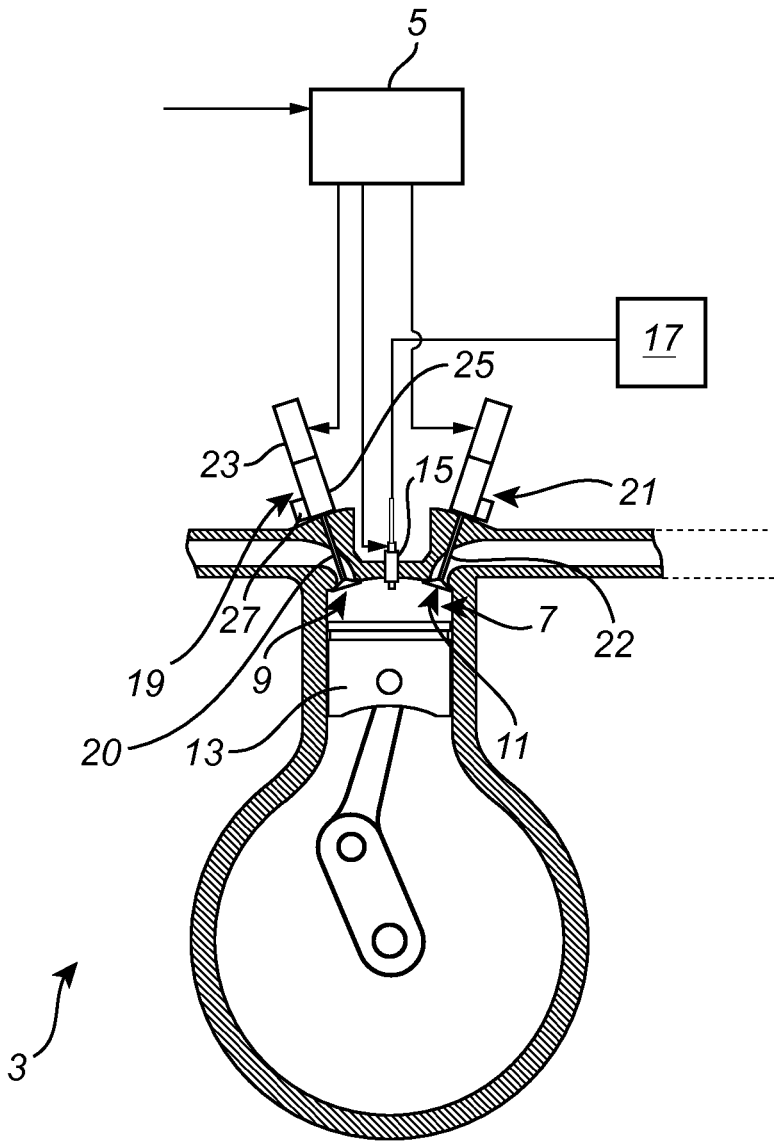
FIG. 2 is a schematic illustration of a part of an ICE arrangement according to an example embodiment of the present invention.

Referring to FIG. 2, the ICE arrangement 3 comprises a cylinder 7 having an inlet 9 and an outlet 11, a piston 13, a fuel supply member 15, a tank for holding fuel 17, a first cylinder valve assembly 19 for controlling flow through the inlet 9 using valve 20, and a second cylinder valve assembly 21 for controlling flow through the outlet 11 using valve 22. As is schematically illustrated in FIG. 2, the first cylinder valve assembly 19 comprises valve 20, valve actuator 23, pneumatic valve spring arrangement 25, and valve spring venting arrangement 27. The second cylinder valve assembly 21 has the same general configuration. As is also schematically shown in FIG. 2, the control unit 5 is connected to, and configured to control operation of, the fuel supply member 15, the first cylinder valve assembly 19, and the second cylinder valve assembly 21.

An example embodiment of the cylinder valve assembly 19 will now be described with reference to FIGS. 3A-B.

As was mentioned above in connection with FIG. 2, the cylinder valve assembly 19 comprises a valve 20, a valve actuator (not shown in FIG. 3A), a pneumatic valve spring arrangement 25, and a spring venting arrangement 27.

Figure 3A:
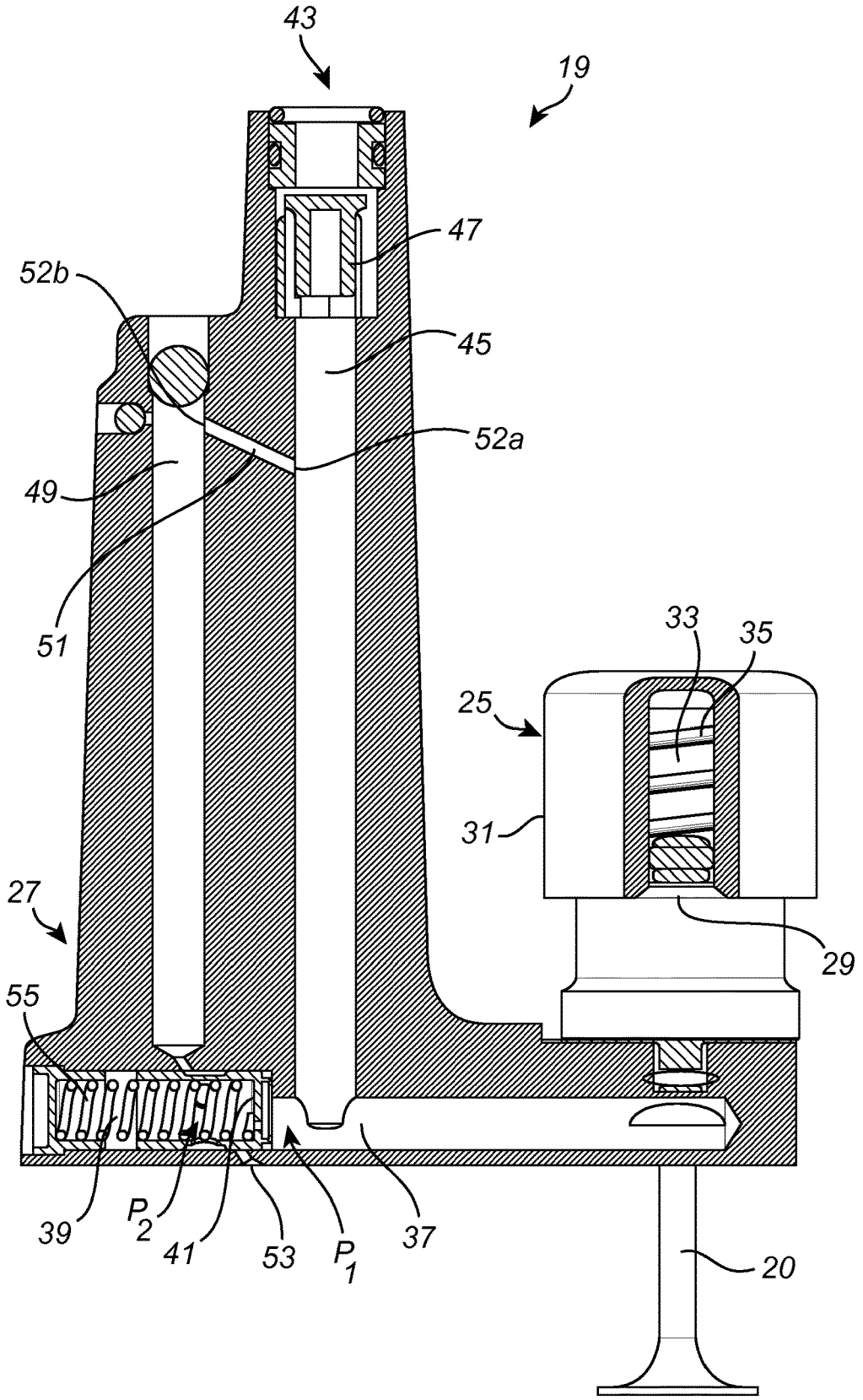
FIG. 3A schematically illustrates an example embodiment of a cylinder valve assembly according to the present invention.

Referring to FIG. 3A, the pneumatic valve spring arrangement includes a first valve spring member 29 and a second valve spring member 31, defining a valve spring cavity 33, and a coil spring 35. The coil spring 35 can be dimensioned to be relatively weak, and the main return force acting on the valve 20 when it is opened by the valve actuator may result from compression of the gas inside the valve spring cavity 33.

Figure 3B:
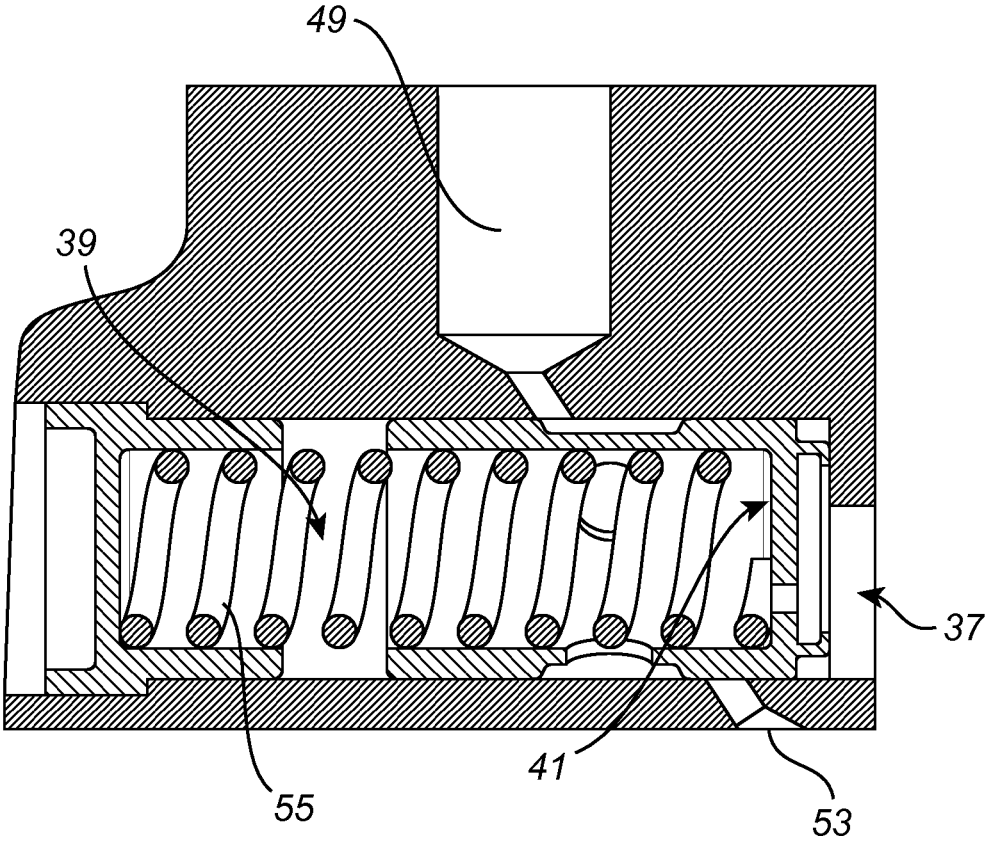
FIG. 3B is an enlargement of a portion of the cylinder valve assembly in FIG. 3A.

With continued reference to FIG. 3A and FIG. 3B, the valve spring venting arrangement 27 comprises a first venting cavity portion 37 fluid flow connected with the valve spring cavity 33, a second venting cavity portion 39, a movable sealing member 41 arranged to allow a pressure difference between a first gas pressure $P_1$ in the first venting cavity portion 37 and a second gas pressure $P_2$ in the second venting cavity portion 39, a gas inlet 43, an inlet channel 45, a check valve 47, a counter-pressure channel 49, a pressure-levelling channel 51, a venting channel 53, and an elastic member 55.

In the example embodiment of FIG. 3A and FIG. 3B, the inlet channel 45, the counter-pressure channel 49, and the pressure-levelling channel 51 together form a feedback channel fluid flow connecting the first venting cavity portion 37 and the second venting cavity portion 39.

As is also indicated in FIG. 3A, a first end 52*a* of the pressure levelling channel 51 fluid flow connected to the inlet channel 45 is at a lower vertical level than a second end 52*b* of the pressure levelling channel 51 fluid flow connected to the counter-pressure channel 51.

Furthermore, a cross-sectional area of the pressure-levelling channel 51 is smaller than a cross-sectional area of the inlet channel 45 and a cross-sectional area of the counter-pressure channel 49. It should be noted that the first venting cavity portion 37 is in fluid flow connection with the valve spring cavity 33 through a flow channel having a first minimum cross-sectional area, and that the feedback channel has a second minimum cross-section area smaller than the first minimum channel cross-sectional area. In the example embodiment of FIGS. 3A-B, the second minimum cross-sectional area is the cross-sectional area of the pressure-levelling channel 51.

A valve lift sequence, including valve spring venting, using the cylinder valve assembly 19 in FIGS. 3A-B will now be described with reference to the timing diagram 57 in FIG. 4. The timing diagram 57 in FIG. 4, which is based on a simulation of the cylinder valve assembly 19 in FIGS. 3A-B, includes a first curve 59 representing displacement of the valve 20 during an opening sequence of the valve 20, a second curve 61 representing the first gas pressure $P_1$ in the first venting cavity portion 37, a third curve 63 representing the second gas pressure $P_2$ in the second venting cavity portion 39, a fourth curve 65 representing displacement of the sealing member 41, and a fifth curve 67 representing flow through the venting channel 53.

Figure 4:
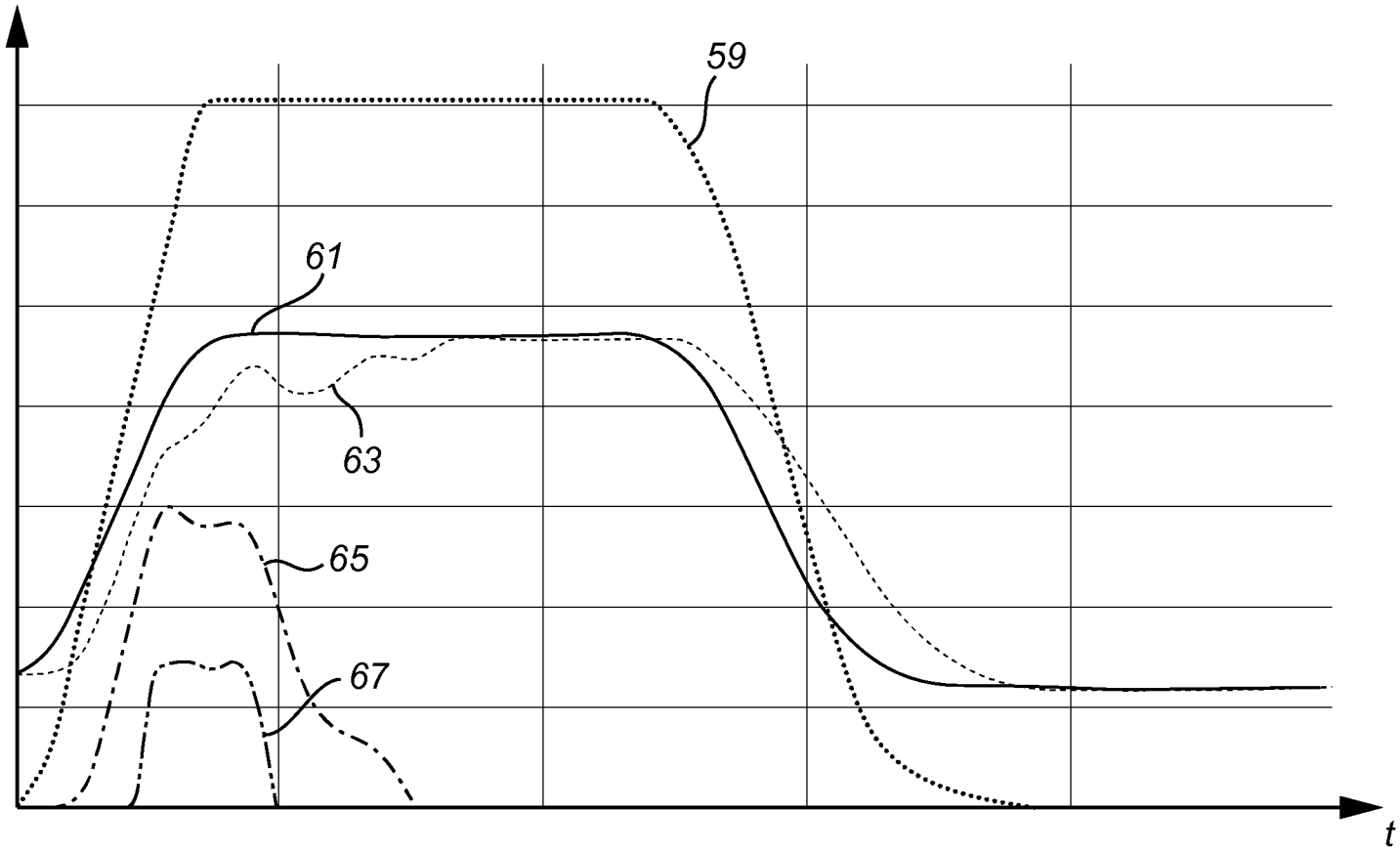
FIG. 4 is a diagram illustrating an example venting sequence of the cylinder valve assembly in FIGS. 3A-B.

As can be seen in FIG. 4, the variation of the first pressure $P_1$ (curve 61) follows the displacement of the valve 20 (curve 59) (and the corresponding pressure increase inside the valve spring cavity 33) with practically no delay. The variation of the second pressure $P_2$ (curve 63) is, however, delayed in relation to the first pressure $P_1$ (curve 61), due to the passage of gas through the feedback channel, which comprises the input channel 45, the counter-pressure channel 49, and the pressure-levelling channel 51 in the example configuration of FIGS. 3A-B. Due to the initial pressure difference between the first pressure $P_1$ (curve 61) and the second pressure $P_2$ (curve 63), the sealing member 41 moves away from the first sealing member position (the position shown in FIG. 3B) to the second sealing member position, where a fluid passage between the first venting cavity portion 37 and the venting channel 53 is opened (towards the left in FIG. 3B). As was mentioned above, this movement of the sealing member is represented by the fourth curve 65 in FIG. 4. When the second pressure $P_2$ (curve 63) again "catches up" with the first pressure $P_1$ (curve 61) so that the combined force from the left in FIG. 3B resulting from the second pressure $P_2$ and the elastic member 55 acting on the sealing member 41 surpasses the force from the right resulting from the first pressure $P_1$ acting on the sealing member 41, the sealing member 41 moves back to close the venting channel 53. This movement back and forth of the sealing member 41 results in the flow of gas (which may advantageously include oil mist) represented by the fifth curve 67 in FIG. 4 through the venting channel 53.

It is to be understood that the present invention is not limited to the embodiments described above and illustrated in the drawings; rather, the skilled person will recognize that many changes and modifications may be made within the scope of the appended claims.

The invention claimed is:

1. A cylinder valve assembly for an internal combustion engine, comprising:

a valve;

a valve actuator for moving said valve; and a pneumatic valve spring arrangement including a first valve spring member and a second valve spring member defining a valve spring cavity, said second valve spring member being arranged to move in relation to said first valve spring member to compress gas in said valve spring cavity when said valve actuator moves said valve, wherein said cylinder valve assembly further comprises a valve spring venting arrangement comprising:

a first venting cavity portion in fluid flow connection with said valve spring cavity to receive gas from said valve spring cavity;

a second venting cavity portion;

a movable sealing member arranged to allow a pressure difference between a first gas pressure in said first venting cavity portion and a second gas pressure in said second venting cavity portion;

a feedback channel allowing fluid flow through the feedback channel from said first venting cavity portion to said second venting cavity portion; and a venting channel for gas exhaust from said valve spring venting arrangement, wherein said sealing member is configured to be movable between:

a first sealing member position in which said sealing member is arranged in such a way that said sealing member prevents fluid flow from said first venting cavity portion through said venting channel; and a second sealing member position in which said sealing member is arranged in such a way that said sealing member allows fluid flow from said first venting cavity portion through said venting channel, wherein said valve spring venting arrangement further comprises an elastic member urging said sealing member to move from said second sealing member position towards said first sealing member position.

2. The cylinder valve assembly according to claim 1, wherein:

said sealing member is configured to receive a first force resulting from the first gas pressure in said first venting cavity portion, and a second force resulting from the second gas pressure in said second venting cavity portion;

said first force is directed to urge said sealing member to move towards said second sealing member position, and said second force is directed to urge said sealing member to move towards said first sealing member position; and said feedback channel, said sealing member, and said elastic member are dimensioned in such a way that said sealing member is moved from said first sealing member position to said second sealing member position during a portion of a time when said valve actuator moves said valve.

3. The cylinder valve assembly according to claim 1, further comprising a gas inlet for providing gas to said pneumatic valve spring arrangement.

4. The cylinder valve assembly according to claim 3, further comprising an inlet channel allowing fluid flow between said gas inlet and the first venting cavity portion of said valve spring venting arrangement.

5. The cylinder valve assembly according to claim 4, further comprising a counter-pressure channel that allows fluid flow to said second venting cavity portion.

6. The cylinder valve assembly according to claim 5, wherein said feedback channel comprises said inlet channel, said counter-pressure channel, and a pressure-levelling channel connected to allow fluid flow between said inlet channel and said counter-pressure channel.

7. The cylinder valve assembly according to claim 6, wherein a cross-sectional area of said pressure-levelling channel is smaller than a cross-sectional area of said inlet channel and a cross-sectional area of said counter-pressure channel.

8. The cylinder valve assembly according to claim 6, wherein a first end of said pressure levelling channel that is connected to said inlet channel is at a lower vertical level than a second end of said pressure levelling channel that is connected to said counter-pressure channel.

9. The cylinder valve assembly according to claim 1, wherein said valve actuator is a pneumatic actuator.

10. An internal combustion engine arrangement, comprising:

a cylinder having an inlet and an outlet; and the cylinder valve assembly according to claim 1 arranged to allow control of fluid flow through at least one of the inlet and the outlet of said cylinder.

11. A vehicle comprising the internal combustion engine arrangement according to claim 10.

* * * * *